United States Patent [19]

Lutz et al.

[11] 4,379,821

[45] Apr. 12, 1983

[54] ELECTROPHOTOGRAPHIC RECORDING MATERIAL WITH $AS_2SE_{3-x}TE_x$ CHARGE GENERATING LAYER

[75] Inventors: Manfred Lutz; Bernd Reimer, both of Warstein, Fed. Rep. of Germany

[73] Assignee: Licentia Patent-Verwaltungs-GmbH, Frankfurt am Main, Fed. Rep. of Germany

[21] Appl. No.: 269,941

[22] Filed: Jun. 3, 1981

[30] Foreign Application Priority Data

Jun. 3, 1980 [DE] Fed. Rep. of Germany ..... 3020939

[51] Int. Cl.[3] ..... G03G 5/04

[52] U.S. Cl. ..... 430/58; 430/84

[58] Field of Search ..... 430/57, 58, 65, 84, 430/86

[56] References Cited

U.S. PATENT DOCUMENTS

| | | | |
|---|---|---|---|
| 2,962,376 | 11/1960 | Schaffert | 430/57 |
| 3,655,377 | 4/1972 | Sechak | 96/1.5 |
| 3,861,913 | 1/1975 | Chiou | 430/58 |
| 4,088,485 | 5/1978 | Ing et al. | 430/58 |
| 4,187,104 | 2/1980 | Tutihasi | 430/57 |
| 4,314,014 | 2/1982 | Yamamoto et al. | 430/57 |

FOREIGN PATENT DOCUMENTS

| | | |
|---|---|---|
| 2248054 | 12/1974 | Fed. Rep. of Germany . |
| 1597882 | 9/1976 | Fed. Rep. of Germany . |

OTHER PUBLICATIONS

"Rear ir Sensitive Electrophotographic Receptor", Ishiwata et al., *J. Appl. Phys.* 51(1), 1/80, pp. 444 & 445.

*Primary Examiner*—Richard L. Schilling
*Attorney, Agent, or Firm*—Spencer & Kaye

[57] ABSTRACT

An electrophotographic recording material including a dual photoconductive layer containing selenium applied to an electrically conductive substrate. The dual photoconductive layer includes a layer of arsenic selenide applied to the substrate, and a layer of an arsenic-selenium-tellurium compound superposed on the arsenic selenide layer. The arsenic-selenium-tellurium compound has the formula $As_2Se_{3-x}Te_x$, where $0<X<3$.

8 Claims, 2 Drawing Figures

ELECTROPHOTOGRAPHIC RECORDING MATERIAL WITH $AS_2SE_{3-x}TE_x$ CHARGE GENERATING LAYER

BACKGROUND OF THE INVENTION

The present invention relates to an electrophotographic recording material including a dual photoconductive layer containing selenium applied on an electrically conductive substrate.

Electrophotographic recording materials are used for electrophotographic copying processes which have found wide application in the photocopying art. Such processes are based on the property of the photoconductive material to change its electrical resistance when exposed to an activating radiation.

After a photoconductive layer has been electrically charged and exposed to an activating radiation in a pattern corresponding to an optical image, a latent electrical charge image, which corresponds to the optical image, is produced on the photoconductive layer. At the exposed locations, the conductivity of the photoconductive layer is increased to such an extent that the electric charge can flow off, at least in part and through the conductive substrate, but in any event the flow off is at a greater extent at the exposed locations than at the unexposed locations. At the unexposed locations, the electric charge should remain essentially intact, and the pattern of the charge can then be made visible by means of an image powder, a so-called toner. The resulting toner image, if necessary, can then be transferred to paper or a similar record carrier.

Electrophotographically active substances which have been employed include organic as well as inorganic substances. Among the inorganic substances which have been used, selenium, selenium alloys and compounds with selenium have gained particular significance. They play an important role particularly in their amorphous state and have found many uses in practice.

The change in the electrical conductivity of a photoconductor depends on the intensity and the wavelength of the radiation employed. Within the range of visible light which is preferred for practical use in electrophotography, for example in office copiers, the amorphous selenium exhibits high sensitivity on the blue side, i.e. in the short-wave range, whereas on the red side, i.e. in the longwave range, it exhibits a very low sensitivity.

The result is that a red character is reproduced on an electrophotographic plate in the same manner as a black character, which under certain circumstances, particularly with colored masters, may present practical disadvantages, since a black character on a red background—or vice versa—will not be distinguishable from its background and can not, therefore, be made visible. For wavelengths in the infrared range, amorphous selenium is not suitable at all.

In contradistinction to amorphous selenium, crystallized selenium is known to be red sensitive. Thus, the use of crystallized selenium makes possible reproduction involving this part of the visible spectrum. However, the high dark conductivity of crystallized selenium, i.e. its characteristic of being such a good conductor for electric current while in the unexposed state that a charge applied to its surface cannot be maintained for the length of time required for electrophotographic purposes, discourages its use for such purposes.

Additions to selenium, such as, for example, arsenic or tellurium, are known to broaden the spectral sensitivity of selenium into the longer wave spectral range. However, systems comprised of selenium and tellurium alloys present disadvantages in that it is more difficult to prepare the photoconductive layer, since alloys are more difficult to evaporate homogeneously. Moreover, with a higher tellurium concentration, the photoconductive layer exhibits an undesirable tendency toward crystallization and thus has only a short service life.

Moreover, no selenium based photoconductors are known which have a significant and practically usable sensitivity extending into a wavelength range of over 800 nm.

Sensitivity in that range is the desired behavior, however, if electrophotography is also to be used to advantage for other purposes. For example, data output devices operate with infra-red (IR) solid state lasers as radiation sources, in a wavelength range from about 800 to 850 nm. If such radiation is to be detected by a photoconductor, the photoconductor must be sensitive in such a wavelength range.

SUMMARY OF THE INVENTION

It is therefore an object of the present invention to provide an electrophotographic recording material which is as panchromatic as possible, and which has a photoconductor sensitive both in the visible light and in the infra-red spectral ranges, so that it can be used both in conventional office copiers and with data output devices that may be operated with solid state laser radiation.

It is a further object of the present invention to provide a photoconductor which constitutes a mechanically hard and thermally stable system, to assure a long service life.

To achieve these objects, and in accordance with its purpose, the present invention provides an electrophotographic recording material including a dual photoconductive layer containing selenium, applied to an electrically conductive substrate. The photoconductive layer includes a layer of amorphous arsenic selenide disposed on the substrate, and a layer of a compound of arsenic, selenium, and tellurium of the formula $As_2Se_{3-x}Te_x$, where $0<X<3$, superposed on the arsenic selenide layer.

In three component compounds of the formula $As_2Se_{3-x}Te_x$, it is, of course, necessary that $0<X<3$. Preferably, however, $0.05<X<2.5$ and most preferably $0.1<X<0.5$.

The thickness of the $As_2Se_3$ layer should be 20 to 100μ, preferably 50 to 60μ. Thicknesses of 0.5 to 10μ, preferably 2 to 5μ, are preferred for the thickness of the $As_2Se_{3-x}Te_x$ layer.

The electrically conductive substrate is preferably made of aluminum or metallized plastic.

By utilizing the present invention, the recording material can be used to advantage not only in the prior art applications, but also in wavelength ranges over 800 nm. for example 810 nm to 850 nm, and up to about 950 nm. Thus, electrophotography is opened to new applications. Moreover, the dual photoconductive layer of the present invention has the particular advantage that the layer which generates the charge carrier, the $As_2Se_{3-x}Te_x$ layer, and the layer which transports the charge carrier, the $As_2Se_3$ layer, can be adapted and optimized individually to the desired requirements. For example, it is possible, if required, to use a charge carrier generating layer which has a higher conductivity than the photoconductive layer which could be used in a single layer system. A high conductivity layer cannot be used in a single layer system because of unduly high dark discharge.

It is to be understood that both the foregoing general description and the following detailed description are exemplary, but are not restrictive of the invention.

DESCRIPTION OF THE PREFERRED EMBODIMENTS

The electrophotographic recording material according to the invention can be produced by conventional methods. For example, the dual photoconductor layer can be produced by applying both layers to the conductive substrate in a vapor deposition process at a pressure of about $p=10^{-4}$ mbar. For this purpose, a first thermal evaporator is filled with about 90 g $As_2Se_3$ and a second thermal evaporator is filled with about 8 g $As_2Se_{3-x}Te_x$. Once a pressure of about $p=10^{-2}$ mbar is reached in the vacuum system, an aluminum substrate is cleansed by means of a glow discharge and is subsequently heated to a temperature of about 210°-220° C. Then, at a pressure of about $p=10^{-4}$ mbar, the first evaporator is brought to a temperature of about 370° C. and is held at this temperature until the entire amount of $As_2Se_3$ weighed in has evaporated. This can be controlled during the vapor-deposition process by means of a layer thickness gauge. Subsequently, the second evaporator is brought to a temperature of 380°-390° C. and is likewise kept at this temperature until the entire amount of $As_2Se_{3-x}Te_x$ weighed in has evaporated.

After cooling, an electrophotographic recording material results which contains a highly sensitive panchromatic photoconductor.

Figure 1:
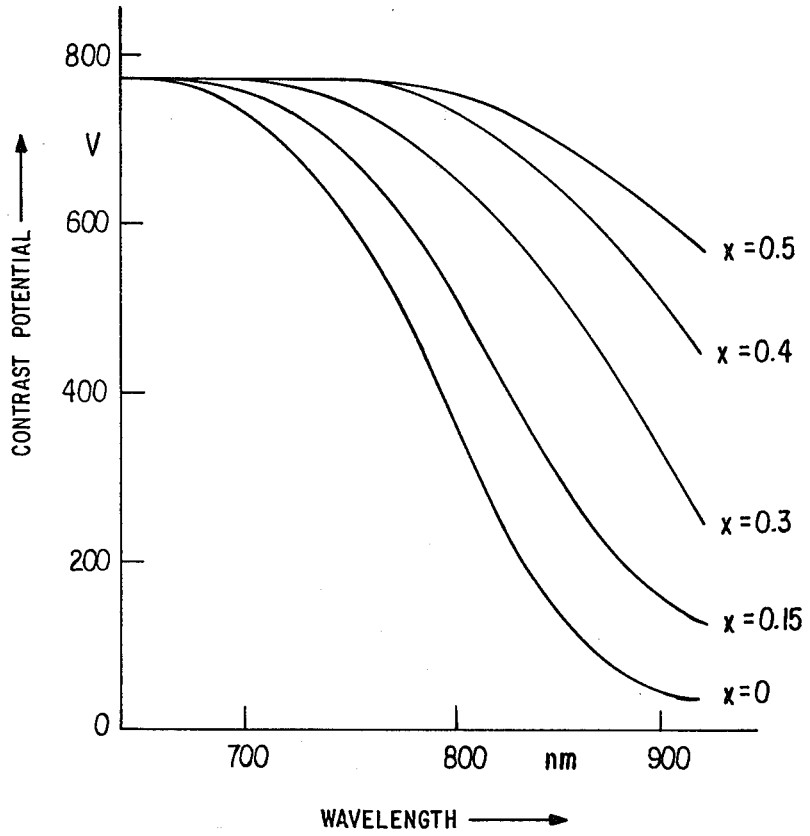
FIG. 1 is a graph of contrast potential vs. wavelength for photoconductor layers of various compositions.

FIG. 1 is a graph of the contrast potential of various dual layers produced according to the present invention, as a function of the irradiated light wavelength. FIG. 1 further shows a curve with x=0, which corresponds to a dual layer where each layer contains $As_2Se_3$. As can be seen from FIG. 1, with increasing tellurium content (x values in the formula $As_2Se_{3-x}Te_x$), the sensitivity is extended more and more into the IR spectral range. With a charging potential of $V_o=+800$ V, a wavelength of $\lambda=800$ nm, and an illumination intensity of about 3.5 $\mu J/cm^2$ (microjoules/$cm^2$), the contrast potential realized is 375 V for x=0 ($As_2Se_3$), where the As-Se-Te compound of the present invention is not present, and is higher than 375 V, such as 760 V for x=0.5 ($As_2Se_{2.5}Te_{0.5}$), for the photoconductor according to the present invention. The composition of the second photoconductive layer can easily be adapted to the given requirements.

If necessary, the photoconductive layers can also be produced according to other known methods.

Figure 2:
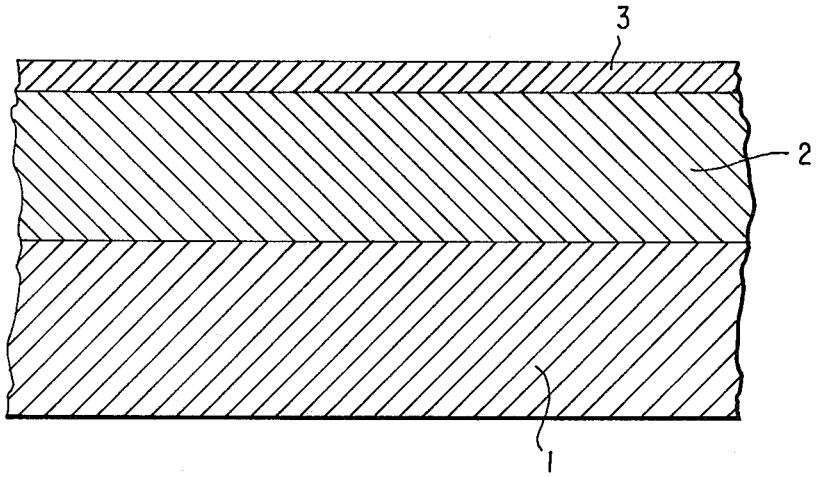
FIG. 2 is a schematic cross-sectional view of an electrophotographic recording material produced in accordance with the present invention.

FIG. 2 shows the layer structure of a recording material according to the invention. On a conductive substrate 1, which is preferably made of aluminum or of metallized plastic, a first photoconductive layer 2 of arsenic selenide ($As_2Se_3$) is applied, to a layer thickness of 20 to 100$\mu$. On this arsenic selenide layer 2 there is applied a second photoconductive layer 3 whose composition corresponds to the formula $As_2Se_{3-x}T_x$ and which has a thickness of 0.5 to 10$\mu$.

Preferably, the electrophotographic recording material of the present invention contains only the substrate and the dual layer of the present invention.

Both photoconductive layers can prepared as homogeneous layers. Due to their high crystallization temperatures of about 180° C., no tendency toward crystallization at room temperature exists and the service life is long.

It will be understood that the above description of the present invention is susceptible to various modifications, changes and adaptions, and the same are intended to be comprehended within the meaning and range of equivalents of the appended claims.

What is claimed is:

1. In an electrophotographic recording material including a dual photoconductive layer containing selenium applied to an electrically conductive substrate, the improvement wherein the recording material contains only the substrate and the dual photoconductive layer, and the dual photoconductive layer consists of a layer of amorphous arsenic selenide as a charge transporting layer disposed on said substrate, and a layer of a compound of arsenic, selenium, and tellurium of the formula $As_2Se_{3-x}Te_x$, where $0<X<3$, as a charge generating layer, superposed on said layer of arsenic selenide.

2. Electrophotographic recording material according to claim 1, wherein $0.05<X<2.5$.

3. Electrophotographic recording material according to claim 2, wherein $0.1<X<0.5$.

4. Electrophotographic recording material according to claim 1, 2, or 3, wherein the thickness of said layer of arsenic selenide is 20 to 100 microns.

5. Electrophotographic recording material according to claim 4, wherein the thickness of said layer of arsenic selenide is 50 to 60 microns.

6. Electrophotographic recording material according to claim 1, 2 or 3, wherein the thickness of said layer of a compound of arsenic, selenium and tellurium is 0.5 to 10 microns.

7. Electrophotographic recording material according to claim 6, wherein the thickness of said layer of a compound of arsenic, selenium and tellurium, is 2 to 5 microns.

8. Electrophotographic recording material according to claim 1, 2, or 3, used for recording with solid state laser diode radiation in a spectral range up to about 950 nm.

* * * * *